United States Patent [19]

Crooker et al.

[11] Patent Number: 4,964,015

[45] Date of Patent: Oct. 16, 1990

[54] ELECTRICALLY CONDUCTIVE CHAIR SUPPORT WITH SLIDING BUSHING

[75] Inventor: Richard L. Crooker, Canyon Country; Vincent J. Fitzgerald, Westminster; Jeffery D. Campbell, Hawthrone, all of Calif.

[73] Assignee: Zero Corporation, Los Angeles, Calif.

[21] Appl. No.: 328,574

[22] Filed: Mar. 27, 1989

[51] Int. Cl.[5] ..... H05F 3/00; H01R 39/00; A47C 1/00

[52] U.S. Cl. ..... 361/220; 361/212; 297/217; 297/345; 384/9; 384/277; 439/13; 439/620

[58] Field of Search ..... 361/212, 216, 220–224; 297/217, 344, 345, 349; 384/9, 277, 429; 338/20, 21, 64, 230; 439/13, 17–19, 28, 29, 620, 1, 10, 11, 32, 86, 87, 162, 164, 577; 174/51, 78; 310/68 R, 71, 90

[56] References Cited

U.S. PATENT DOCUMENTS

| | | | |
|---|---|---|---|
| 3,271,723 | 9/1966 | Willing | 439/17 |
| 4,444,445 | 4/1984 | Davies et al. | 439/10 |
| 4,513,347 | 4/1985 | Wilcox et al. | 361/212 |
| 4,625,257 | 11/1986 | Lissner | 361/212 |
| 4,747,011 | 5/1988 | Lissner | 361/212 |

*Primary Examiner*—A. D. Pellinen
*Assistant Examiner*—David Osborn
*Attorney, Agent, or Firm*—Harris, Kern, Wallen & Tinsley

[57] ABSTRACT

A chair for conducting the electrostatic charge of an occupant to the floor on which the chair rests, with the chair seat carried on a support unit which permits rotation of the seat and adjustment of the height of the seat above the floor. The support unit includes an outer sleeve and an inner sleeve moving vertically relative to the outer sleeve, and an electrical resistor connected between the inner and outer sleeves and in sliding contact with at least one of the sleeves, typically by means of a spring finger strip mounted in a groove of a bushing or collar.

20 Claims, 2 Drawing Sheets

FIG. 1
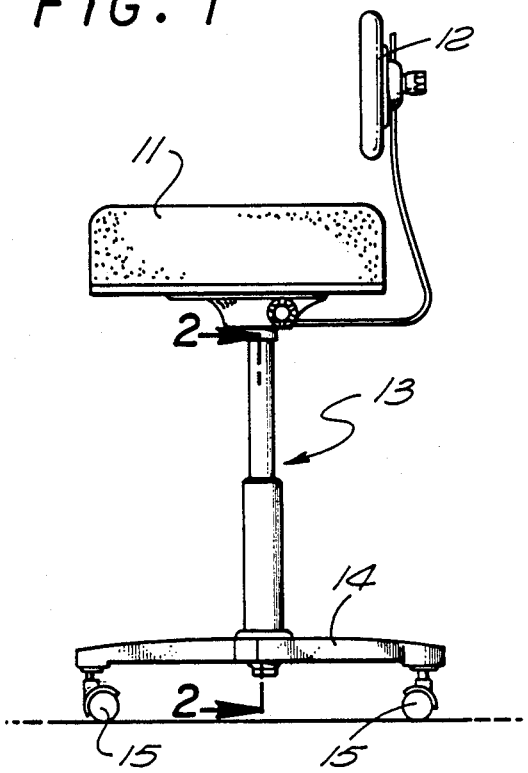
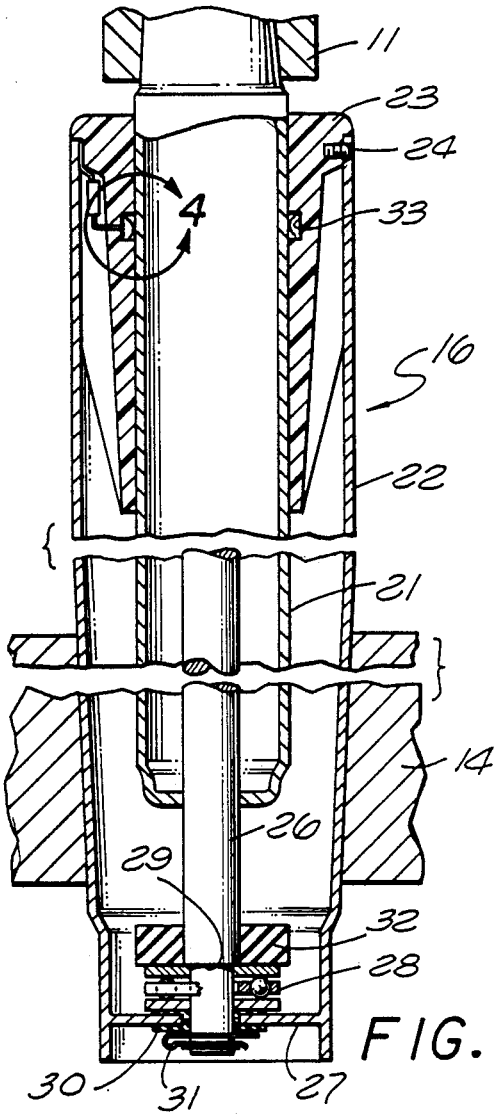
FIG. 2
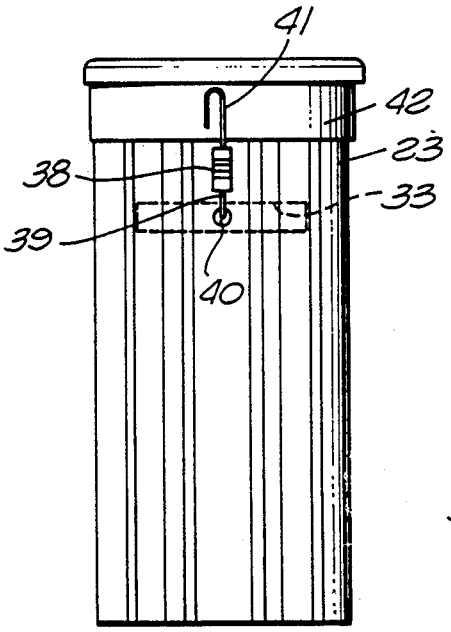
FIG. 3
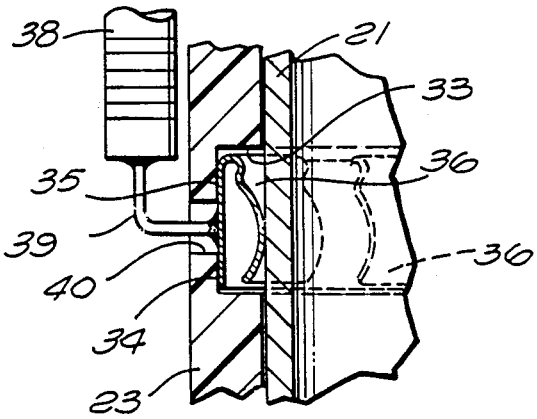
FIG. 4

FIG. 6
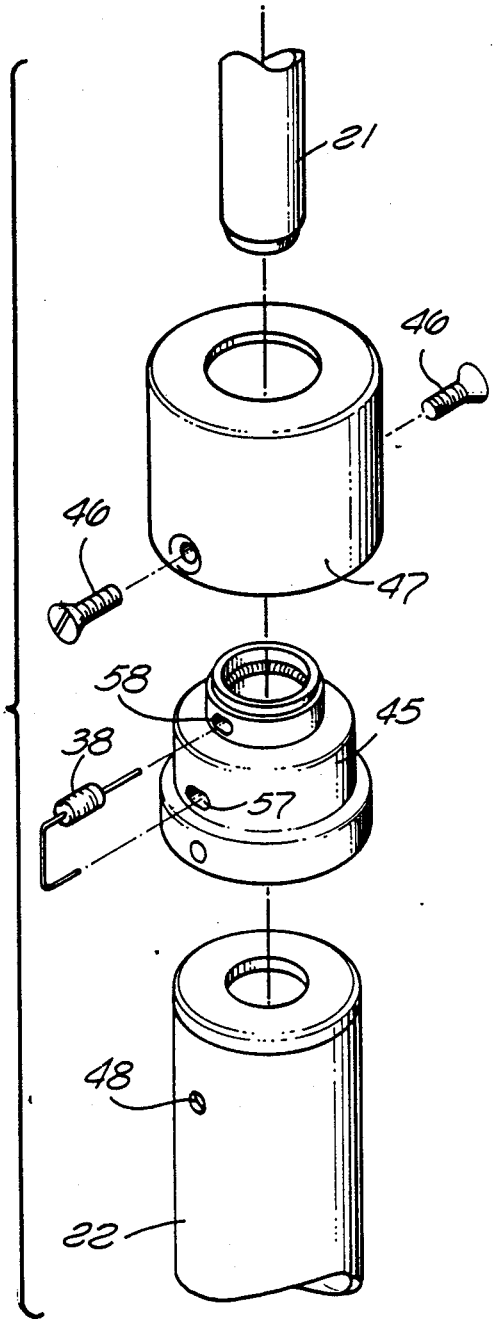
FIG. 5
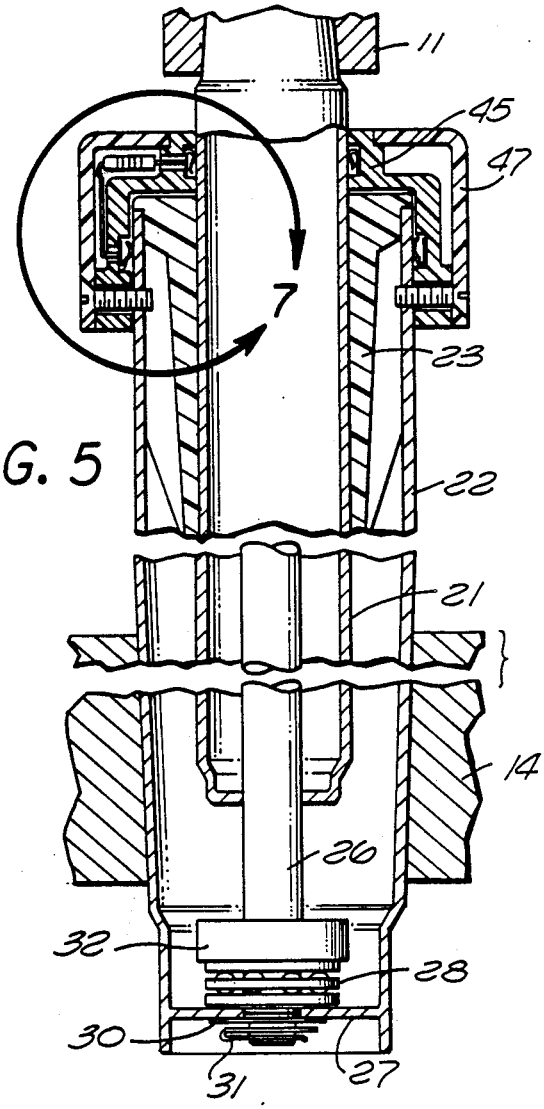
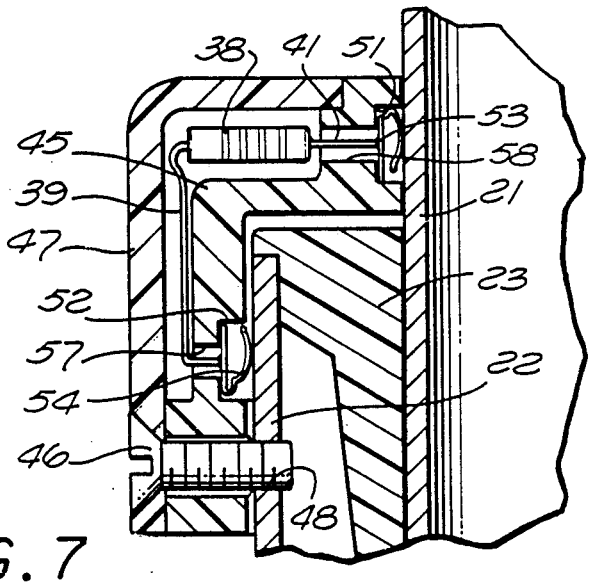
FIG. 7

ELECTRICALLY CONDUCTIVE CHAIR SUPPORT WITH SLIDING BUSHING

BACKGROUND OF THE INVENTION

This invention relates to chairs which provide for discharging the electrostatic charge of an occupant of the chair, which chairs are sometimes referred to as antistatic chairs or static protective chairs.

The electrically conductive chairs are widely used in offices and in factories where it is desirable to avoid build-up of electrostatic charge on the person who is occupying the chair. Many chairs used in such situations provide for rotation of the seat relative to the support base and for raising and lowering of the seat relative to the support base. It is desirable to provide an electrically conductive path from the seat and/or back of the chair to the floor on which the chair rests while also permitting rotation and raising and lowering of the seat relative to the base. A number of designs have been proposed for such a product, and three are shown in U.S. Pat. Nos. 4,513,347; 4,625,257, and 4,747,011. In the electrical conductive chair, it is usually desirable to incorporate an electrical resistance in the electrical path between the seat and the floor and this is accomplished by inserting a resistor, typically a one megohm resistor, in series in the electrical path.

Previous arrangements have been utilized for installing the resistor. By way of example, in U.S. Pat. No. 4,513,347 the resistor is in installed in a plastic sleeve and carried in a plastic shell attached to the chair. In U.S. Pat. No. 4,625,257 the resistor is mounted in an insulating sleeve projecting downward from the seatpost of the chair, with a conducting chain hanging from the resistor or from a zener breakdown device attached to the resistor. In U.S. Pat. No. 4,747,011 two resistors are mounted in a spacer between a base flange and a thrust bearing, with the leads of the resistors on the upper and lower surfaces of the spacer for contacting the thrust bearing and base flange.

There have been problems with stability and reliability and operating life of these prior arrangements, and it is an object of the present invention to provide an electrically conductive chair with a new and improved arrangement for installing an electrical resistance in the electrical conductive path between the chair seat and floor. One problem has been with breaking of the leads of the resistors used in providing the desired electrical resistance.

Other objects, advantages, features and results will more fully appear in the course of the following description.

SUMMARY OF THE INVENTION

A chair having a support unit for adjusting the height of the chair seat above the floor, with the support unit including an outer sleeve and an inner sleeve for providing vertical motion between the sleeves and rotational motion between the sleeves. An electrical resistance device is carried at the support unit in electrical contact with the inner and outer sleeves providing an electrical resistance path between the sleeves. In one embodiment, a spring is positioned in an annular groove in a bushing between the inner and outer sleeves, with the spring providing a sliding electrical contact with the inner sleeve and with a resistor connected between the spring and the outer sleeve. In another embodiment, springs are provided in each of two annular grooves in a collar with a resistor connected between the springs and with one spring providing electrical contact with one sleeve and with the other spring providing electrical contact with the other sleeve.

The invention also includes a bushing for use with sleeves while providing an electrical path between the sleeves during axial and rotational motion.

BRIEF DESCRIPTION OF THE DRAWINGS

FIG. 1 is a side view of an electrically conductive chair;

FIG. 2 is an enlarged partial sectional view of the chair of FIG. 1 illustrating one embodiment of the invention;

FIG. 3 is a side view of the bushing of FIG. 2;

FIG. 4 is an enlarged partial sectional view of the area 4 of FIG. 2;

FIG. 5 is a view similar to that of FIG. 2 showing an alternative and presently preferred embodiment of the invention;

FIG. 6 is an exploded view illustrating the assembly of FIG. 5; and

FIG. 7 is an enlarged sectional view of the area 7 of FIG. 5.

DESCRIPTION OF THE PREFERRED EMBODIMENTS

Referring to FIG. 1, a chair is shown with a seat 11, a back 12, a vertical support post 13, a frame 14, and a plurality of rollers 15. The vertical support post 13 incorporates a hydraulic cylinder unit 16 which is shown in greater detail in FIG. 2, and which provides for raising and lowering of the seat with respect to the frame, and in some instances, for rotation of the seat about the vertical axis relative to the frame.

The seat 11 and/or the back 12 include electrical conductive material which provides an electrical path from an occupant on the chair to the upper end of the hydraulic cylinder unit 16. Similarly, the frame 14 and rollers 15 include material providing an electrically conductive path from the hydraulic cylinder unit to the floor upon which the chair rests. All of the above construction may be conventional in nature, such as that shown in prior patents, and is not set out in detail herein. The new feature of the present invention is the arrangement for providing an electrically conductive path through the hydraulic cylinder unit, with an electrical resistance in this path.

As shown in FIGS. 2–4, the hydraulic cylinder unit 16 includes an inner sleeve 21 and an outer sleeve 22, each made of an electrically conducting material, typically steel. The upper end of the inner sleeve is joined to the seat 11, and the lower end of the outer sleeve is joined to the frame 14.

In the embodiment illustrated, a bushing 23 of electrically insulating material is positioned between the inner and outer sleeves, and is fixed to the outer sleeve by one or more screws 24. The inner sleeve 21 slides vertically in the bushing 23 which provides for maintaining alignment of the inner and outer sleeves.

A piston rod 26 of the hydraulic cylinder unit slides in the inner sleeve 21 and is connected at its lower end to a flange 27 at the lower end of the outer sleeve 22. A thrust bearing 28 is positioned at a shoulder 29 on the lower end of the piston rod 26 and rests on an electrically insulating washer 30. A spring clip 31 is installed at the lower end of the piston rod to retain the rod, and a upper washer 32 is positioned about the rod above the thrust bearing for limiting downward movement of the inner sleeve 21 along the piston rod 26.

An inner annular groove 33 is provided in the bushing 23, and an electrically conductive spring 34 is positioned in the groove 33. The spring may be of conventional construction, and typically is a strip 35 with a plurality of spaced parallel fingers 36. An appropriate length of the spring is cut and is placed in the groove 33, with the strip 35 against the inner wall of the groove and with the individual fingers 36 facing inward to provide a resilient electrically conductive engagement with the outer wall of the inner sleeve 21. An electrical resistor 38 has one lead 39 connected to the spring through an opening 40 in the bushing 23. The other lead 41 of the resistor is positioned along a shoulder 42 of the bushing so that the lead is pressed against the inner wall of the outer sleeve 22 when the bushing is installed in the sleeve. With this arrangement, the resistor provides an electrical path between the inner sleeve and the outer sleeve.

An alternative and presently preferred embodiment of the invention is shown in FIGS. 5–7, where components corresponding to those of FIGS. 2–4 are identified by the same reference numerals.

A collar 45 of electrically insulating material is positioned at the upper end of the outer sleeve 22, and preferably is held in place by screws 46 which pass through aligned openings in a cover or cap 47 and in the collar 45 into threaded openings 48 of the outer sleeve. The collar 45 is shown as a single piece in the drawings, but can be made as one piece or as two or more pieces, as desired. The cover 47 may be utilized to provide mechanical protection, but is not an essential element of the invention.

Two internal annular grooves 51, 52 are provided in the collar 45, and springs 53, 54 are positioned in the grooves 51, 52, respectively. The springs 53 and 54 may be the same in construction as the spring 34. The resistor 34 is connected to each of the springs, with lead 39 in an opening 57 and with lead 41 in an opening 58.

In each of the embodiments, the hydraulic cylinder unit 16 is operated in the conventional manner for raising and lowering the seat and for rotating the seat relative to the base. The resistor provides an electrical resistance path between the inner and outer sleeves, with the desired electrical resistance in the path during the rotational and vertical motions of the chair. A conventional hydraulic cylinder unit can be utilized, merely requiring for the embodiment of FIGS. 2–4, the groove 33 and opening 40, and for the embodiment of FIGS. 5–7, the openings 48 for the mounting screws 46.

With the construction of the present invention as shown in the embodiment of FIGS. 5–7, the electrical grounding path is outside the two sleeves of the cylinder unit and the connections of the electrical resistor are not in a lood bearing condition and hence there is no wear of the ends of the resistor leads. Also the externally portioned resistor with its cover is protected from contamination, such as by the grease associated with the sliding components.

I claim:

1. In a chair having a support unit for adjusting the height of the chair seat above the floor, said support unit including an outer sleeve and an inner sleeve with a guide bushing positioned therebetween at the upper end of said support unit, with said inner sleeve sliding vertically relative to said outer sleeve, and a thrust bearing at the lower end of said support unit, the improvement comprising an electrical resistance device carried at said guide bushing in said support unit remote from said thrust bearing and in electrical contact with said inner and outer sleeves providing an electrical resistance path between said sleeves.

2. A chair as defined in claim 1 wherein said electrical resistance device includes an electrically conducting spring means positioned around an in electrical contact with one of said sleeves.

3. A chair as defined in claim 2 wherein said spring means includes a metal strip with a plurality of parallel fingers, with said metal strip positioned in an arc around the sleeve with said fingers contacting the sleeve.

4. A chair as defined in claim 1 wherein said bushing has an inner annular groove, and said electrical resistance device includes an electrically conducting spring means positioned in said groove in electrical contact with said inner sleeve.

5. In a chair having a support unit for adjusting the height of the chair seat above the floor, said support unit including an outer sleeve and an inner sleeve with a guide bushing positioned therebetween, with said inner sleeve sliding vertically relative to said outer sleeve, the improvement comprising an electrical resistance device carried at said support unit in electrical contact with said inner and outer sleeves providing an electrical resistance path between said sleeves, with said bushing having an inner annular groove, and with said electrical resistance device including an electrically conducting spring means positioned in said groove in electrical contact with said inner sleeve, and with said electrical resistance device including a resistor with two leads, with one of said leads connected to said spring means and with the other of said leads connected to said spring means and with the other of said leads in electrical contact with said outer sleeve.

6. A chair as defined in claim 5 wherein the other of said leads is clamped between said bushing and said outer sleeve.

7. In a chair having a support unit for adjusting the height of the chair seat above the floor, said support unit including an outer sleeve and an inner sleeve with a guide bushing positioned therebetween, with said inner sleeve sliding vertically relative to said outer sleeve, the improvement comprising an electrical resistance device carried at said support unit in electrical contract with said inner and outer sleeves providing an electrical resistance path between said sleeves, and a collar carried on one of said sleeves and sliding axially along the other of said sleeves, with said electrical resistance device carried by said other collar.

8. A chair as defined in claim 7 wherein said collar has a first inner annular groove, and said electrical resistance device includes a first electrically conducting spring means positioned in said first groove.

9. A chair as defined in claim 8 wherein said bushing has a second inner annular groove, and said electrical resistance device includes a second electrically conducting spring means positioned in said second groove.

10. In a chair having a support unit for adjusting the height of a chair seat above the floor, said support unit including an outer sleeve and an inner sleeve with said inner sleeve sliding vertically relative to said outer sleeve, the improvement comprising:

a collar carried on said outer sleeve and sliding along said inner sleeve, with said collar having a first inner annular groove around said inner sleeve and a second inner annular groove around said outer sleeve; and an electrical resistance device carried in said collar and having a first electrically conducting spring means in said first groove and a second electrically conducting spring means in said second groove, and a resistor with two leads, with one lead connected to said first spring means and the other lead connected to said second spring means.

11. A chair as defined in claim 10 wherein said resistor is positioned on the exterior of said collar, and including a cover enclosing said resistor.

12. A bushing for outer and inner sleeves with said inner sleeve sliding and rotating relative to said outer sleeve, the bushing comprising:

a collar for carrying on said outer sleeve and sliding along said inner sleeve, with said collar having a first inner annular groove around said inner sleeve and a second inner annular groove around said outer sleeve; and an electrical resistance device carried in said collar and having a first electrically conducting spring means in said first groove and a second electrically conducting spring means in said second groove, and a resistor with two leads, with one lead connected to said first spring means and the other lead connected to said second spring means.

13. A bushing as defined in claim 12 wherein said resistor is positioned on the exterior of said collar, and said bushing includes a cover enclosing said resistor.

14. A bushing for an outer sleeve having an outer surface, and having an inner sleeve sliding within and axially relative to said outer sleeve and having an outer surface, the bushing comprising:

a collar being carried on and fixed to said outer surface of one said sleeves and sliding axially along said outer surface of the other of said sleeves; and an electrical resistance device carried by said collar for electrical contact with said outer surfaces of said inner and outer sleeves, said device having a relatively high resistance element positioned between relatively low resistance end members for sliding contact with said outer surfaces of said sleeves.

15. A bushing as defined in claim 14 wherein said electrical resistance device includes an electrically conducting spring means positioned around and in electrical contact with one of said sleeves.

16. A bushing for an outer sleeve and an inner sleeve sliding axially relative to said outer sleeve, the bushing comprising:

a collar being carried on one of said sleeves and sliding axially along the other of said sleeves; and an electrical resistance device carried by said collar for electrical contact with said inner and outer sleeves and providing an electrical resistance path between said sleeves, said electrical resistance device including an electrically conducting spring means positioned around and in electrical contact wit one of said sleeves, and said spring means including a metal strip with a plurality of parallel fingers, with said metal strip positioned in an arc around the sleeve with said fingers contacting the sleeve.

17. A bushing for an outer sleeve having an inner sleeve sliding axially relative to said outer sleeve, the bushing comprising:

a collar being carried on one of said sleeves and sliding along the other of said sleeves; and an electrical resistance device carried by said collar for electrical contact with said inner and outer sleeves and providing an electrical resistance path between said sleeves; with said collar having an annular groove, and with said electrical resistance device including an electrically conducting spring means positioned in said groove in electrical contact with said inner sleeve, and with said electrical resistance device including a resistor with two leads, with one of said leads connected to said spring means and wit the other of said leads in electrical contact with said outer sleeve.

18. A bushing as defined in claim 17 wherein the other of said leads is clamped between said bushing and said outer sleeve.

19. A bushing for an outer sleeve and an inner sleeve sliding axially relative to said outer sleeve, the bushing comprising:

a collar being carried on one of said sleeves and sliding axially along the other of said sleeves; and an electrical resistance device carried by said collar for electrical contact with said inner and outer sleeves and providing an electrical resistance path between said sleeves, said collar having a first inner annular groove, and said electrical resistance device includes a first electrically conducting spring means positioned in said first groove.

20. A bushing as defined in claim 19 wherein said bushing has a second inner annular groove, and said electrical resistance device includes a second electrically conducting spring means positioned in said second groove.

* * * * *